US007011310B2

(12) United States Patent
Rowan

(10) Patent No.: US 7,011,310 B2
(45) Date of Patent: Mar. 14, 2006

(54) INTERCHANGEABLE MODULAR BALL GAME APPARATUS

(76) Inventor: Marian G. Rowan, 3318 Kennonview Dr., Houston, TX (US) 77068

( * ) Notice: Subject to any disclaimer, the term of this patent is extended or adjusted under 35 U.S.C. 154(b) by 0 days.

(21) Appl. No.: 11/005,404

(22) Filed: Dec. 7, 2004

(65) Prior Publication Data

US 2005/0134001 A1 Jun. 23, 2005

Related U.S. Application Data

(60) Provisional application No. 60/531,661, filed on Dec. 23, 2003.

(51) Int. Cl.
*A63B 63/04* (2006.01)

(52) U.S. Cl. ..... 273/398; 473/476

(58) Field of Classification Search ..... 273/398–402, 273/407; 473/476, 478, 473
See application file for complete search history.

(56) References Cited

U.S. PATENT DOCUMENTS

| | | | | | |
|---|---|---|---|---|---|
| 611,504 | A | * | 9/1898 | Perky | 273/400 |
| 2,008,359 | A | * | 7/1935 | Lamb | 273/402 |
| D213,209 | S | | 1/1969 | Zielinski | |
| 4,344,628 | A | | 8/1982 | Warehime | |
| 4,489,941 | A | * | 12/1984 | Shieh | 473/197 |
| 4,826,164 | A | * | 5/1989 | Butcher | 473/456 |
| 4,905,996 | A | * | 3/1990 | Tallent et al. | 473/197 |
| 4,936,578 | A | * | 6/1990 | Hudson, Sr. | 473/439 |
| 4,940,232 | A | * | 7/1990 | Chen | 473/416 |
| 4,948,147 | A | * | 8/1990 | Pallanca | 273/402 |
| 5,181,725 | A | | 1/1993 | Leras et al. | |
| 5,232,217 | A | | 8/1993 | Cota et al. | |
| 5,330,199 | A | | 7/1994 | Vand | |
| 5,403,000 | A | | 4/1995 | Woosley | |
| 5,529,294 | A | | 6/1996 | Nordman et al. | |
| 5,549,302 | A | | 8/1996 | Lapsker et al. | |
| 5,558,338 | A | | 9/1996 | Taub | |
| 5,584,480 | A | * | 12/1996 | Grimsrud | 473/416 |
| 5,611,539 | A | * | 3/1997 | Watterson et al. | 473/197 |
| 5,688,196 | A | | 11/1997 | O'Neil | |
| 5,692,979 | A | * | 12/1997 | Jones | 473/470 |
| 5,695,415 | A | | 12/1997 | Docherty et al. | |
| 5,709,620 | A | | 1/1998 | Reinprecht | |
| 5,711,727 | A | | 1/1998 | Edge et al. | |
| 5,720,485 | A | | 2/1998 | Oswald | |
| 5,810,363 | A | | 9/1998 | Saunders et al. | |
| 5,865,691 | A | | 2/1999 | Chen | |
| 5,906,554 | A | | 5/1999 | Oswald | |
| 5,916,048 | A | | 6/1999 | Hurell et al. | |
| 6,299,556 | B1 | * | 10/2001 | Redden | 473/483 |

(Continued)

FOREIGN PATENT DOCUMENTS

| | | |
|---|---|---|
| DE | 3503549 | 8/1986 |

(Continued)

*Primary Examiner*—Mark S. Graham
(74) *Attorney, Agent, or Firm*—Richard C. Litman

(57) ABSTRACT

The multidimensional interchangeable modular ball game apparatus is used for building game playing skills, such as hand-to-eye and foot-to-eye coordination. The apparatus can be used for throwing, kicking or hitting any type of sports ball and can help with practicing all types of sports, as well as with early childhood development and rehabilitation. The apparatus includes a base with a stem extending from the base. Arms of different lengths are supported by the stem and may also be placed at different heights. Different geometrically shaped hoops and targets of varying sizes and colors can be made with an open or closed net. Another embodiment includes a horizontal beam stand with hoops attached to the stand.

15 Claims, 9 Drawing Sheets

U.S. PATENT DOCUMENTS

| | | | |
|---|---|---|---|
| 6,367,948 | B1 | 4/2002 | Branson |
| 6,398,673 | B1 | 6/2002 | Maruca |
| 6,402,153 | B1 | 6/2002 | Stewart |
| 6,520,874 | B1 | 2/2003 | Beazley |
| 2001/0009874 | A1 | 7/2001 | Beazley |
| 2003/0116917 | A1 | 6/2003 | Thiemann |
| 2004/0038759 | A1 * | 2/2004 | Kuzia et al. ..... 473/478 |

FOREIGN PATENT DOCUMENTS

| | | | |
|---|---|---|---|
| GB | 2255021 | A | 4/1991 |
| GB | 2300362 | A | 5/1996 |

* cited by examiner

INTERCHANGEABLE MODULAR BALL GAME APPARATUS

CROSS-REFERENCE TO RELATED APPLICATION

This application claims the benefit of U.S. Provisional Patent Application Ser. No. 60/531,661, filed Dec. 23, 2003.

BACKGROUND OF THE INVENTION

1. Field of the Invention

The present invention relates generally to a ball game apparatus. More particularly, the present invention relates to an interchangeable, modular ball game apparatus that has a variety of hoops, features and functions.

2. Description of the Related Art

There are literally a limitless number of ball-based games that have been developed in the marketplace. These games utilize a wide variety of balls, shapes and goals with a plurality of features such as bells, flashing lights or movement of the goals. Many of these game apparatus are reflected in the related art.

U.S. Des. Pat. No. 213,209, issued to Zielinski on Jan. 14, 1969, shows an ornamental design for a combined target and game board.

U.S. Patent Publication No. 2001/0009874, published on Jul. 26, 2001, describes the use of a game goal apparatus that is intended to be played within a swimming pool, and which uses a substantially planar backboard at opposite ends of the swimming pool. Each backboard is designed to be used in conjunction with a water polo ball. Each backboard includes an opening which may connect with a net mounted on the backboard to guide the ball when the ball passes through the opening to be deposited on the water directly adjacent the rear surface of the backboard.

U.S. Patent Publication No. 2003/0116917, published on Jun. 26, 2003, teaches the use of a target game device played with a ball or other projectile for use in places such as amusement parks, arcades or at home. An essential element of the game device is that a variety of special effects are used to add excitement as a player gets closer to winning. The game device has one or more target(s) at which a projectile, such as a ball, is tossed or rolled by one or more players of the game.

U.S. Pat. No. 4,344,628, issued to Warehime on Aug. 17, 1982, discloses the use of a rugged, practical, and portable turnstile goal, having two to five relatively large-sized paddle type elements of a grid construction, a simple, rugged and concealed turnstile rotary friction control system, and a simple, reliable and highly visible turnstile fractional rotation indicating system.

U.S. Pat. No. 5,181,725, issued to Leras et al. on Jan. 26, 1993, describes the use of a soccer shooting training target which may be easily rolled up and transported, and which can be installed over an existing soccer goal. The target has a plurality of individual targets containing flaps sized to admit passage of a soccer ball. The soccer shooting training target's upper edge is tied in place to the goal's rear crossbar using a weighted rope. The bottom corners of the soccer shooting training target are tied down using an elastic cord and stakes in order to render the target stable in the presence of wind.

U.S. Pat. No. 5,232,217, issued to Cota et al. on Aug. 3, 1993, teaches the use of a triple-play game that allows three games to be played indoors: basketball, tetherball and targetboard. All three games utilize a pole positioned vertically between the ceiling and floor of a room. Basketball is played with a ball attached to a line having its other end attached to a wrist strap. The basketball backboard is clipped to the pole and has a ball-hoop having a narrow frontal opening.

U.S. Pat. No. 5,330,199, issued to Vand on Jul. 19, 1994, discloses the use of an annular-netted target that can rotate to different angles, as well as to different heights. The target will assist in the teaching and drilling of ball placement skills that are essential to a player when playing a field or court sport. The device will also assist the physical education teacher or coach who must teach several students at one time, all with different skill and interest levels.

U.S. Pat. No. 5,403,000, issued to Woosley on Apr. 4, 1995, describes the use of a game ball having an cinflatable bladder or shell with selected portions reduced in thickness to provide transparent or translucent patterns separated by increased thickness defining opaque portions. The interior of the ball is occupied by a breakable liquid illumination device held in a removable housing of transparent or translucent material for conveying illumination from the device to the selected portions of the ball transmitting the illumination exteriorly of the ball for visual observation.

U.S. Pat. No. 5,529,294, issued to Nordman et al. on Jun. 25, 1996, teaches the use of a lighted stand-up target with a housing attached to the playfield and a target switch pivotally mounted to the housing. An array of light emitting diodes (LEDs) are positioned on a printed circuit board (PCB) mounted within the housing. The target switch is actuated each time that it is struck by a pinball. The LEDs are lit, indicating the number of times that the impact target has been struck.

U.S. Pat. No. 5,549,302, issued to Lapsker et al. on Aug. 27, 1996, teaches the use of a device for allowing an athlete to practice various methods of propelling a projectile in a controlled and accurate manner by allowing him or her to place the projectile on a specific location on a target. This device uses hook and loop fastening material on the projectile and the target to allow the athlete to know where the projectile strikes the target and allows him or her to practice various ways of getting the projectile onto the target.

U.S. Pat. No. 5,558,338, issued to Taub on Sep. 24, 1996, discloses the use of a versatile, multi-use base assembly having a stable support for post-like standards for each series of different games to be played by children. In a football game and in a soccer game, a base supports an upwardly projecting wall. For the soccer game, the wall defines a specially contoured, tension-controlled, resilient target area net for forcibly impinging a ball thereagainst, as occurs during the conduct of a game simulating soccer goal shots.

U.S. Pat. No. 5,688,196, issued to O'Neil on Nov. 18, 1997, describes the use of a portable, remote-controlled, moving target device for throwing practice, which includes a support cable for supporting and carrying a target on an adjustable target support. The adjustable target support includes a hollow upper stem portion and a hollow lower stem portion with a spring within the hollow stem portion that forces the two stem portions together and allows the user to adjust the angle or position between the target and the support cable.

U.S. Pat. No. 5,695,415, issued to Docherty et al. on Dec. 9, 1997, teaches the use of a basketball backboard aiming device. The device includes a backboard member for attachment to a standard basketball hoop. The backboard has a front, planar surface and a linear array of indicia are disposed along the backboard, the array including a plurality of individual targets. Each of the targets is selectively viewable by a shooter disposed along a unique axis forming a preselected angle with respect to the plane of the backboard.

U.S. Pat. No. 5,709,620, issued to Reinprecht on Jan. 20, 1998, discloses the use of an assembly for assisting in the instruction of court or playing-field games, e.g., tennis, the assembly having two-dimensional panels that are strategically positioned on a court. Each panel is made of a flexible, durable material that forms a plane for positioning and repositioning on the surface of a tennis court, thus permitting a tennis instructor to customize tennis lessons according to the specific needs, strengths or weaknesses of a particular student player.

U.S. Pat. No. 5,711,727, issued to Edge et al. on Jan. 27, 1998, describes the use of an illuminated basketball goal with a first light source carried by the perimeter of the backboard and a second light source positioned within a recess formed in the perimeter of the rim. The target square, located on the front face of the backboard, is made of a fluorescent compound, which glows upon activation of the first and second light source. The net depending from the rim is also made of a reflective material.

U.S. Pat. No. 5,720,485, issued to Oswald on Feb. 24, 1998, and U.S. Pat. No. 5,906,554, issued to Oswald on May 25, 1999, disclose the use of a basketball game area for recreation with multiple zones, each having at least one hoop and backboard combination, multiple shooting indicators, and obstacles which can be free standing and/or affixed to the hoop or backboard. The location of the obstacle in relation to the indicator changes the trajectory required to shoot the ball into the hoop. The placement of each indicator increases the difficulty in placing the ball through the hoop.

U.S. Pat. No. 5,810,363, issued to Saunders et al. on Sep. 22, 1998, teaches the use of a target assembly with a variety of non-piercing type projectiles or missiles launched to strike or impinge upon the target, whereupon the latter acts effectively to terminate the flight of the missile. The assembly includes a frame defined by flexible and resilient rods disposed to support a shock-sustainable, shock-resistant tensioned web or target sheet.

U.S. Pat. No. 5,865,691, issued to Chen on Feb. 2, 1999, describes the use of a sports game apparatus including a plurality of U-blocks, a plurality of triangle blocks, a plurality of elongated tubes, a plurality of L-bars, a plurality of angle connectors, and a plurality of coupling tubes adapted to be alternatively arranged into a framework for a net assembly for badminton or tennis, a framework for a goal for soccer or hockey, or a framework for a backstop for basketball.

U.S. Pat. No. 5,916,048, issued to Hurell et al. on Jun. 29, 1999, describes the use of an illuminated basketball goal with a first light source by the perimeter of a backboard and a second light source positioned within a recess formed in the perimeter of the rim. The target square, located on the front face of the backboard, is made of an electroluminescent material or fluorescent compound, which glows upon activation of the first and second light source.

U.S. Pat. No. 6,367,948, issued to Branson on Apr. 9, 2002, describes the use of a self-contained lighting apparatus releasably supported by a conventional translucent basketball backboard. The lighting apparatus includes a translucent front panel and a back panel defining an interior chamber. A reflective surface is disposed within the interior chamber and a plurality of substantially uniform distributed light sources are supported near the reflective surface.

U.S. Pat. No. 6,398,673, issued to Maruca on Jun. 4, 2002, describes the use of a hoop-toss game simulative of basketball that has a backboard assembly with a backboard, a basketball hoop attached to the backboard whenever it is in use, and a horizontally disposed extensible frame. A central portion of the frame is fixedly attached to the backboard and two side portions of the frame have rails that are telescopically attached to the central portion.

U.S. Pat. No. 6,402,153, issued to Stewart on Jun. 11, 2002, discloses the use of a game that includes a base and a toy figure holding a basketball-type hoop. The toy figure is resiliently supported upon a base by a spring support. A sensing lever on the figure responds to the passage of a ball through the hoop to provide a first switch condition. A motion sensor within the figure responds to impact against the figure to provide a second switch condition. A sound and control circuit is operative within the figure and responds to switch conditions to play appropriate audible messages from a stored memory.

U.S. Pat. No. 6,520,874, issued to Beazley on Feb. 18, 2003, discloses the use of a game goal apparatus, which is intended to be played within a swimming pool, and which uses a substantially planar backboard at opposite ends of the swimming pool. Each backboard is designed to be used in conjunction with a water polo ball. Each backboard includes a through opening which may connect with a net mounted on the backboard to guide the ball when it passes through the opening to be deposited on the water directly adjacent to the rear surface of the backboard.

German Patent No. 3,503,549, published on Aug. 7, 1986, shows the use of a goal with changing set targets for the purposes of sport, leisure activities, fitness training and entertainment. The actions are spontaneously transmitted in the absence of a physical component. The constantly changing set targets reproduce the multifarious aspect of a ball game in the goal area and the set targets are moved by the force of impact from the ball on rotary bodies.

Great Britain Patent Application Number 2,300,362, published on Nov. 6, 1996, shows the use of a ball game practice aid that includes a ground or attachable support with target space defining frames attachable at different heights and positions of the support to extend upwards and/or sideways to the ground.

None of the above inventions and patents, taken either singly or in combination, is seen to describe the instant invention as claimed. Thus an interchangeable, modular ball game apparatus solving the aforementioned problems is desired.

SUMMARY OF THE INVENTION

The present invention is an interchangeable, modular ball game apparatus used for developing game-playing skills, such as hand-to-eye and foot-to-eye coordination. The apparatus can be used as a goal or target for throwing, kicking or hitting any type of sports ball and can help with practicing all types of sports, as well as with early childhood development and rehabilitation. The apparatus includes a base with a stem or post extending from the base. Arms of different lengths are supported by the stem and may also be placed at different heights. Hoops and targets of varying sizes and colors, and which can be furnished with an open net, a closed net, or a bounce-back net can be attached to the arms and/or to the top of the stem. The arms on the apparatus may be tilted so that the hoops can be positioned in any manner suitable for the user.

The ball game apparatus includes a vertical stem extension that allows numerous nets or canopies to be attached to the extension on several apparatuses to either form an enclosure or provide a setup for a volleyball or tennis game.

A connector may be attached to the stem to allow for additional arms to be added to the apparatus.

Another embodiment of the ball game apparatus includes a horizontal stand to which numerous hoops may be attached so that users are able to practice throwing balls at different sizes and types of hoops.

Accordingly, it is a principal object of the invention to provide a modular ball game apparatus that can be used for many different types of ball games.

It is another object of the invention to provide a modular ball game apparatus that has interchangeable hoops and targets of different shapes, sizes and colors.

Still another object of the invention is to provide a modular ball game apparatus that may be played with a plurality of sports balls of different sizes and shapes.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
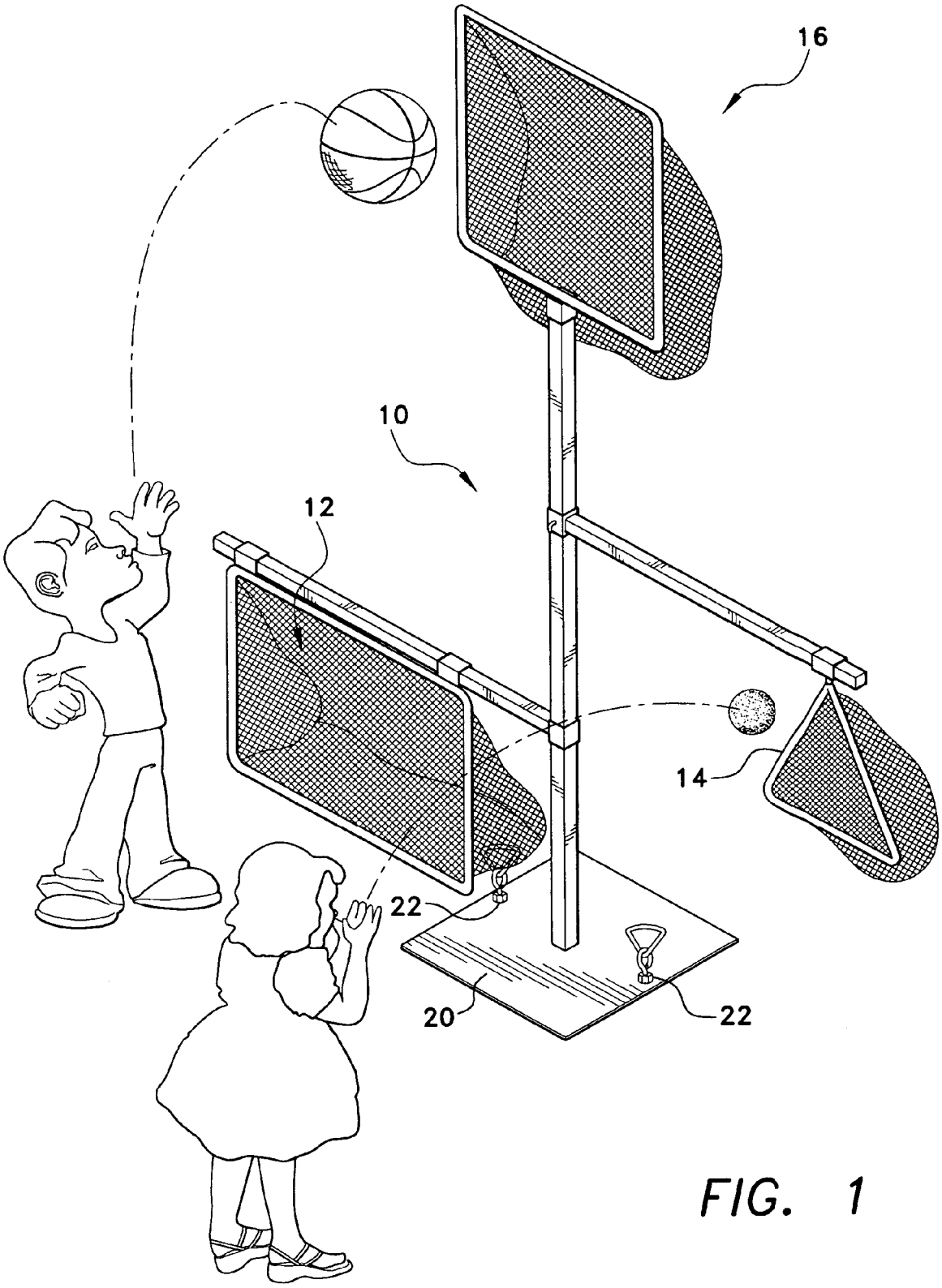
FIG. 1 is an environmental, perspective view of an interchangeable, modular ball game apparatus according to the present invention.

The present invention is an interchangeable, modular ball game apparatus. The apparatus is intended for use either as a training aid, or for use as a goal in either a conventional ball game, or in games devised for the goal configurations made possible by the apparatus. As shown in FIG. 1 the apparatus 10 is capable of supporting multiple hoops, including, among others, a large elongated net 12 for soccer, lacrosse and similar games, small triangular hoops 14 which can serve as targets for practicing baseball pitching and the like, overhead hoops 16 for practicing basketball shooting, etc.

Figure 2:
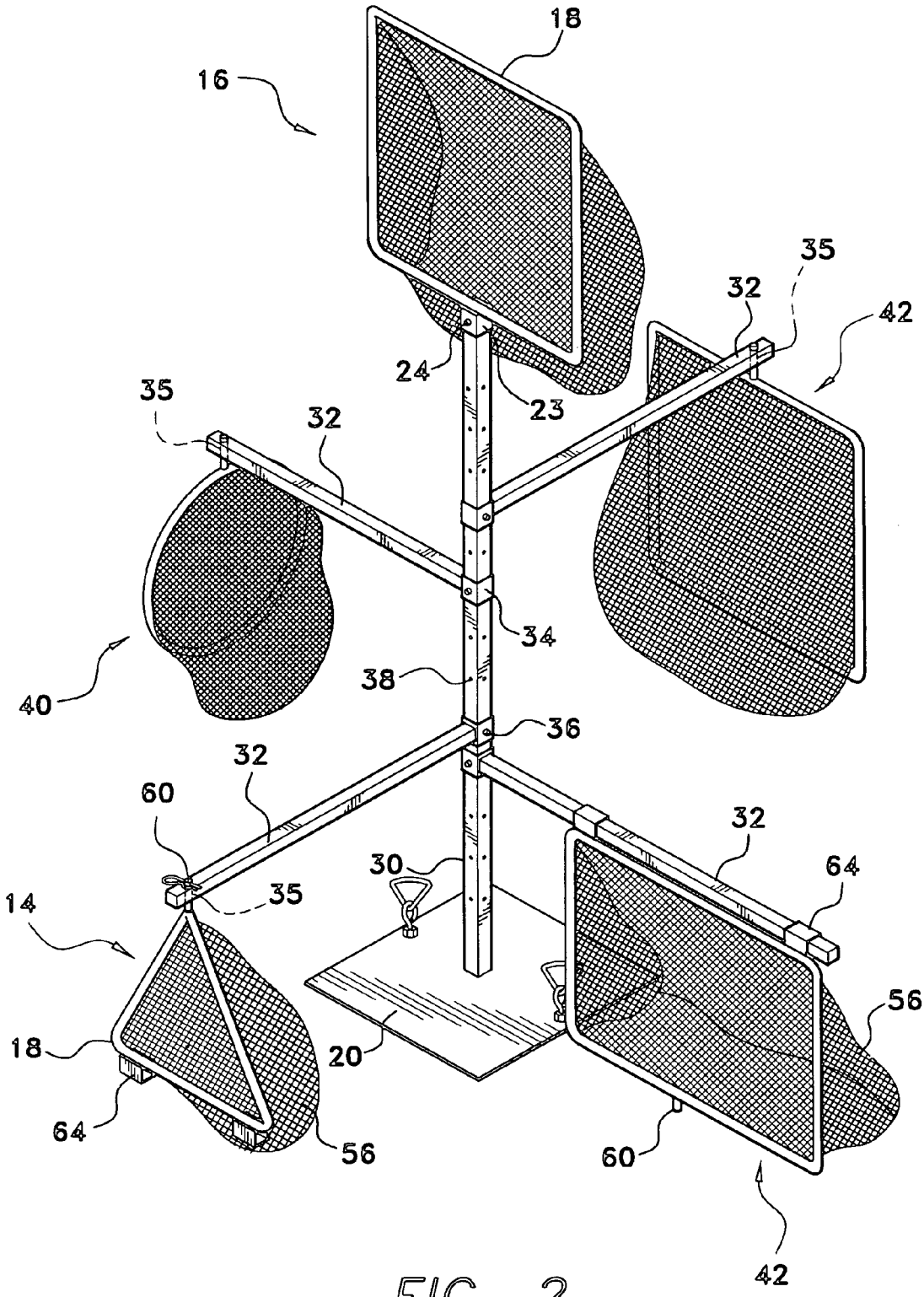
FIG. 2 is a perspective view of an interchangeable modular ball game apparatus according to the present invention.

As shown in FIG. 2, the apparatus 10 comprises a base 20 and a stem 30 extending upward from the base 20. The base 20 is a flat plate or planar member. The stem 30 may be supported on the base 20 in any convenient manner, e.g., by a tube or saddle adapted to receive the bottom of the stem 30, by screwing the stem 30 onto mounting holes provided in the base 20, or by welding the stem 30 straight onto the base 20. The base 20 may be held to the ground or surface upon which the base 20 is to rest by using anchoring holes 22 built into the base 20 and an anchoring means for anchoring the base 20 to the ground. Preferably the stem 30 is bolted to the base 20, but in permanent installations the stem 30 may be fixed to the base 20 by welding or other joinery techniques.

The stem 30 is made from tubing, which may either be round tubing or square tubing, as shown in the drawings. The stem 30 may be furnished in an assortment of selected heights, such as four, six, or eight feet. The stem 30 may support at least one hoop 16 directly, e.g., by a tubular mount 23 extending downward from the rim 18 of the hoop 16, the tubular mount 23 having a diameter slightly greater than the stem 30 so that the mount 23 telescopes over the top end of the stem 30. The tubular mount 23 may be secured to the stem 30 by a pin 24 or bolt inserted through aligned apertures in the mount 22 and the top end of the stem 30, or may be permanently attached to the stem 30 by welding or the like.

The stem 30 is capable of supporting a plurality of arms 32. The arms 32 may be tubular, or made from solid material. Although the arms 32 may be permanently attached to the stem 30, the apparatus 10 has more functionality when the arms 32 may be selectively mounted on the stem 30, so that the number of arms 32, the height of the arms 32, and the radial direction in which the arms 32 extend from the stem 30 are all adjustable. This is accomplished by permanently attaching a tubular mounting sleeve 34 to one end of each arm 32. The mounting sleeve 34 has a diameter slightly greater than the diameter of the stem 30 so that the mounting sleeve 34 telescopes onto the top end of the stem 30 and slides down to the desired height.

The height of the arm 32 can be temporarily fixed in various ways. In the drawings, the height of the arms 32 is fixed by inserting a pin 36 or bolt through aligned apertures in the mounting sleeve 34 and the stem 30. The stem 30 may be provided with a plurality of apertures 38 defined therein and spaced apart vertically at predetermined heights, as well as radially at predetermined angles. In the event that the stem 30 is made from square tubing, this enables an arm to extend to the front, back, left side, or right side of the stem 30. In the event that the stem 30 is made from round tubing, the same pin 36 and mounting hole 38 arrangement may allow arms 32 to extend at 90°, 120°, or other angular spacing about the stem 30.

Figure 5:
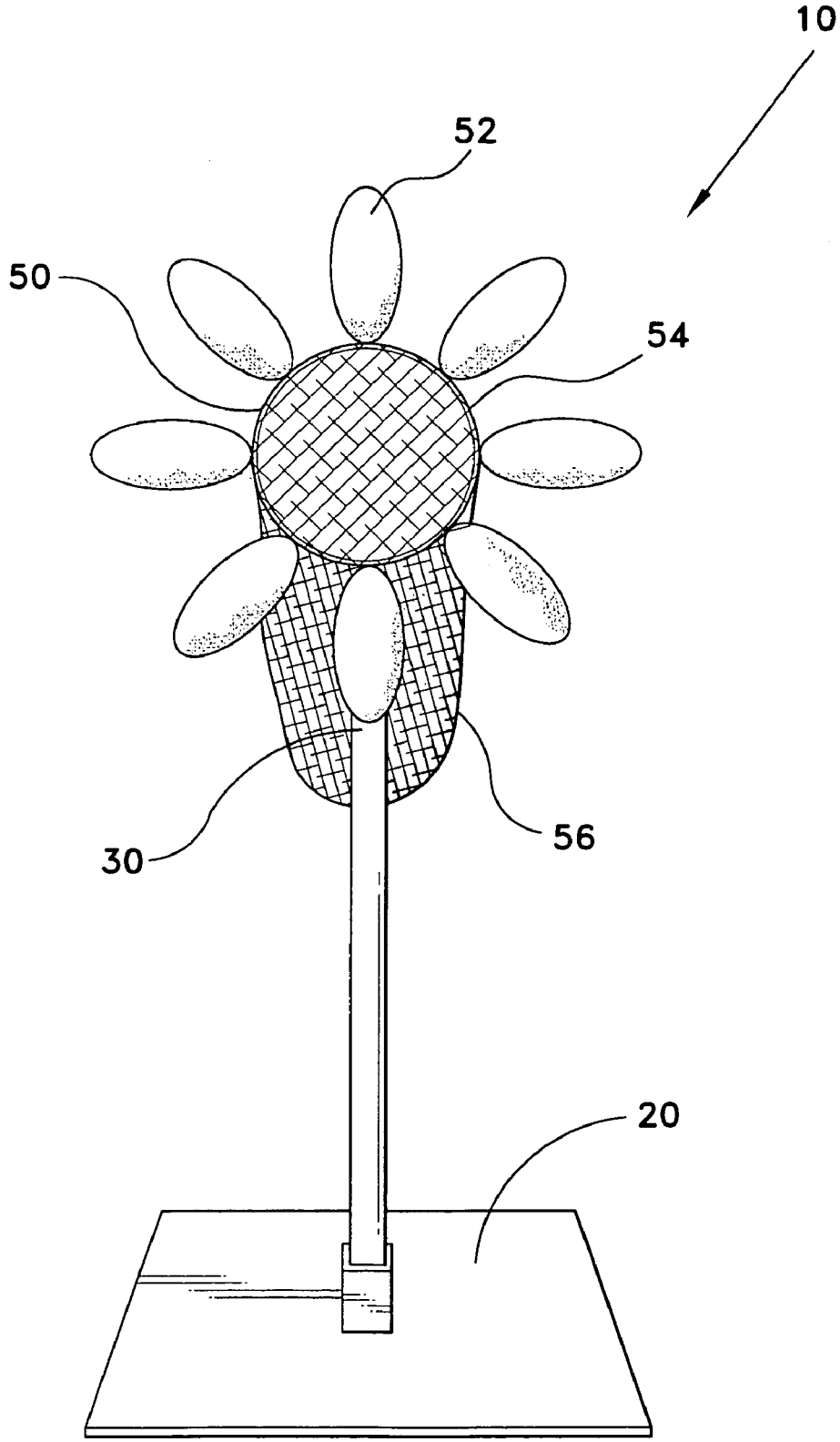
FIG. 5 is a front perspective view of an alternative hoop attached to the interchangeable, modular ball game apparatus of the present invention.

The arms 32 support hoops of various shapes and sizes. Referring particularly to FIG. 2, the arms 32 may support circular hoops 40, triangular hoops 14, square hoops 42, or hoops of any desired geometric shape. As shown in FIG. 1, the arms 32 may support an elongated soccer style net 12. As shown in FIG. 5, the hoop 50 may be furnished with decorative ornaments, such as flower petals 52 attached to the rim 54, which lend a modern art affect to the appearance of the apparatus 10.

Each hoop has a rim 18 and a net 56 attached to the rim 18. The rim 18 can be made of round or square tubing. The net 56 has a mesh that may be made from metal, nylon cord, or any other appropriate material. The net 56 may have a closed bottom, so that balls entering the net 56 are retained therein, or an open bottom, so that balls entering the net 56 pass through the net 56.

Figure 3:
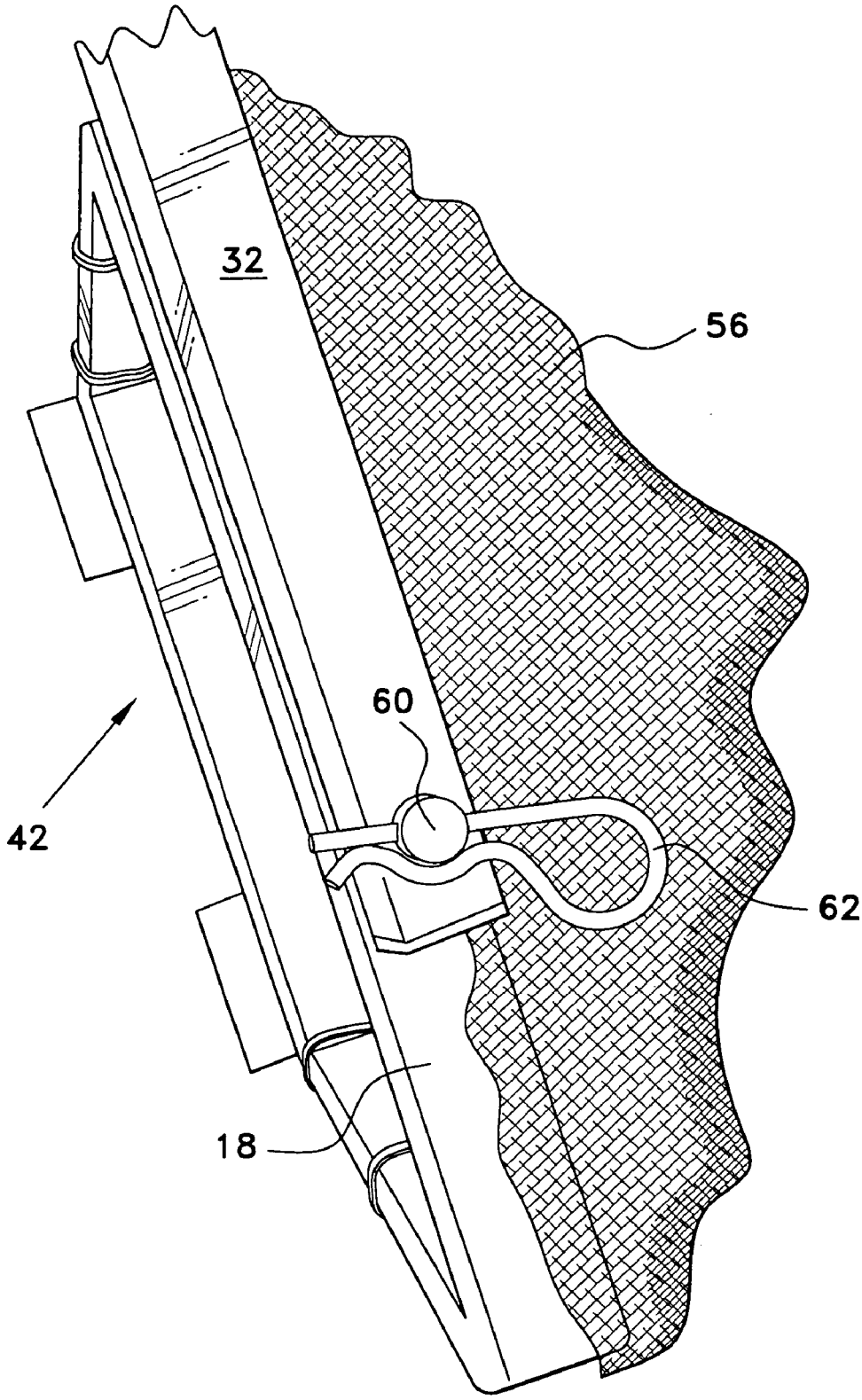
FIG. 3 is a perspective view seen from the top of a pin attachment assembly used to attach a hoop to an arm of the interchangeable, modular ball game apparatus of the present invention.

The hoops may be attached to the arms 32 in various ways. As shown in FIG. 2 and FIG. 3, the hoop may have a pin 60 extending from the rim 18 which may be inserted through aligned apertures or a bore 35 defined through the arm 32. The pin 60 may be secured by a hitch pin 62, cotter pin, or other fastener inserted through a transverse bore defined through the mounting pin 60. As shown in FIG. 2 with respect to triangular hoop 14 and circular hoop 40, in this case the hoop is supported by a single fastener, so that if the mounting pin 60 is cylindrical, the hoop may be free to rotate about a vertical axis.

Figure 4:
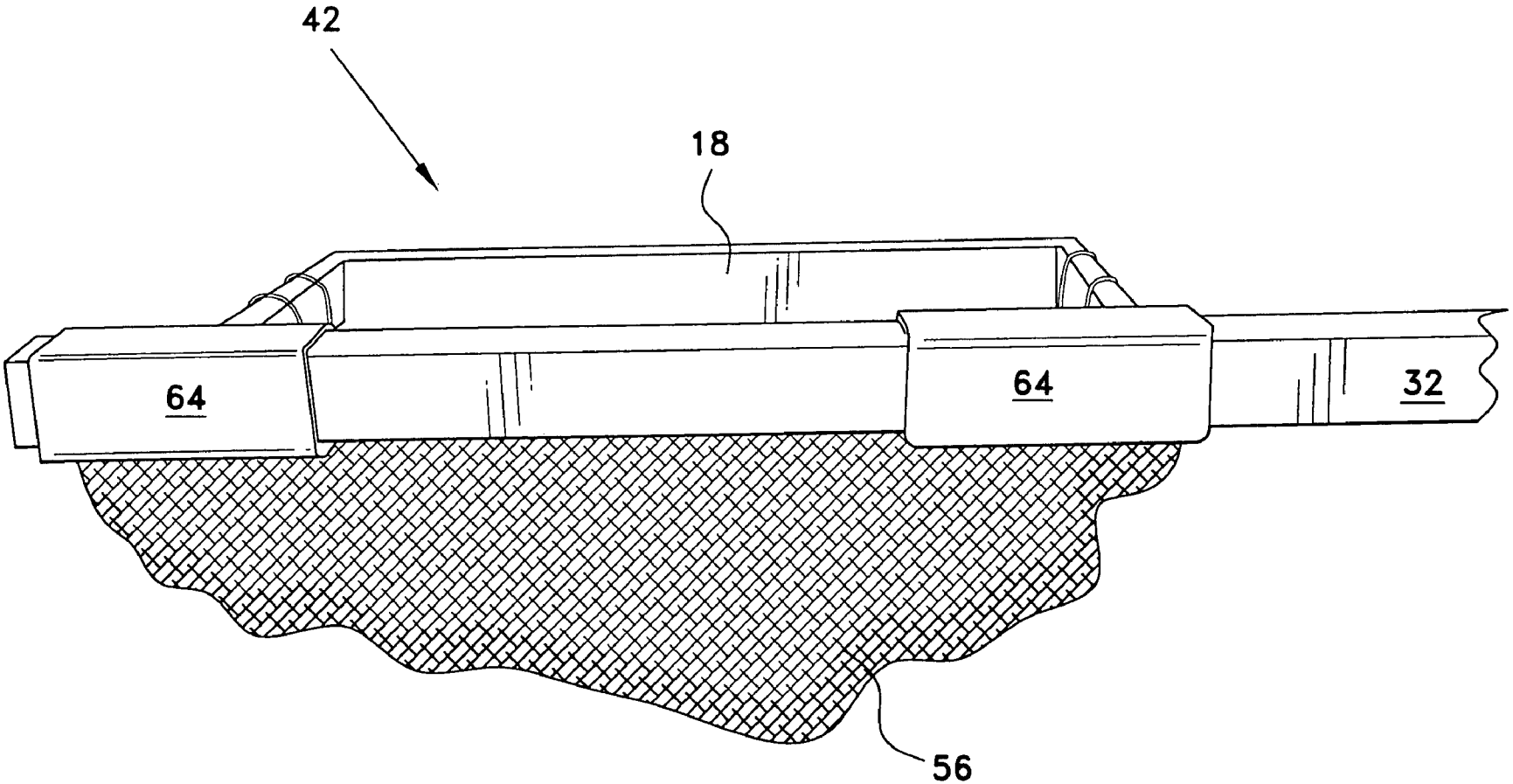
FIG. 4 is a perspective view as seen from the top of the sleeves used to attach a hoop to an arm of the interchangeable, modular ball game apparatus of the present invention.

Alternatively, as shown in FIG. 4, the hoop 42 may be supported on the arm 32 by a pair of spaced apart mounting sleeves 64 mounted on one leg of the rim 18, so that the mounting sleeves 64 slide onto the arm 32. In the event that the arm 32 and the mounting sleeves 64 are made from square tubing, the hoop 42 is precluded from rotation about the arm 32. However, if the arm 32 is cylindrical and the mounting sleeves 64 are made from cylindrical tubes, the hoop 42 may be free to rotate about a horizontal axis. Furthermore, as shown in FIG. 2, a single hoop may have pin 60 at one end for attachment to the arm 32 by a single fastener, and a pair of sleeves 64 at the opposite end, so that the user may select the manner in which the hoop is supported, and in the case of triangular hoops 14 and the like, the user may select the orientation of the hoop (apex oriented upward or downward).

Figure 6:
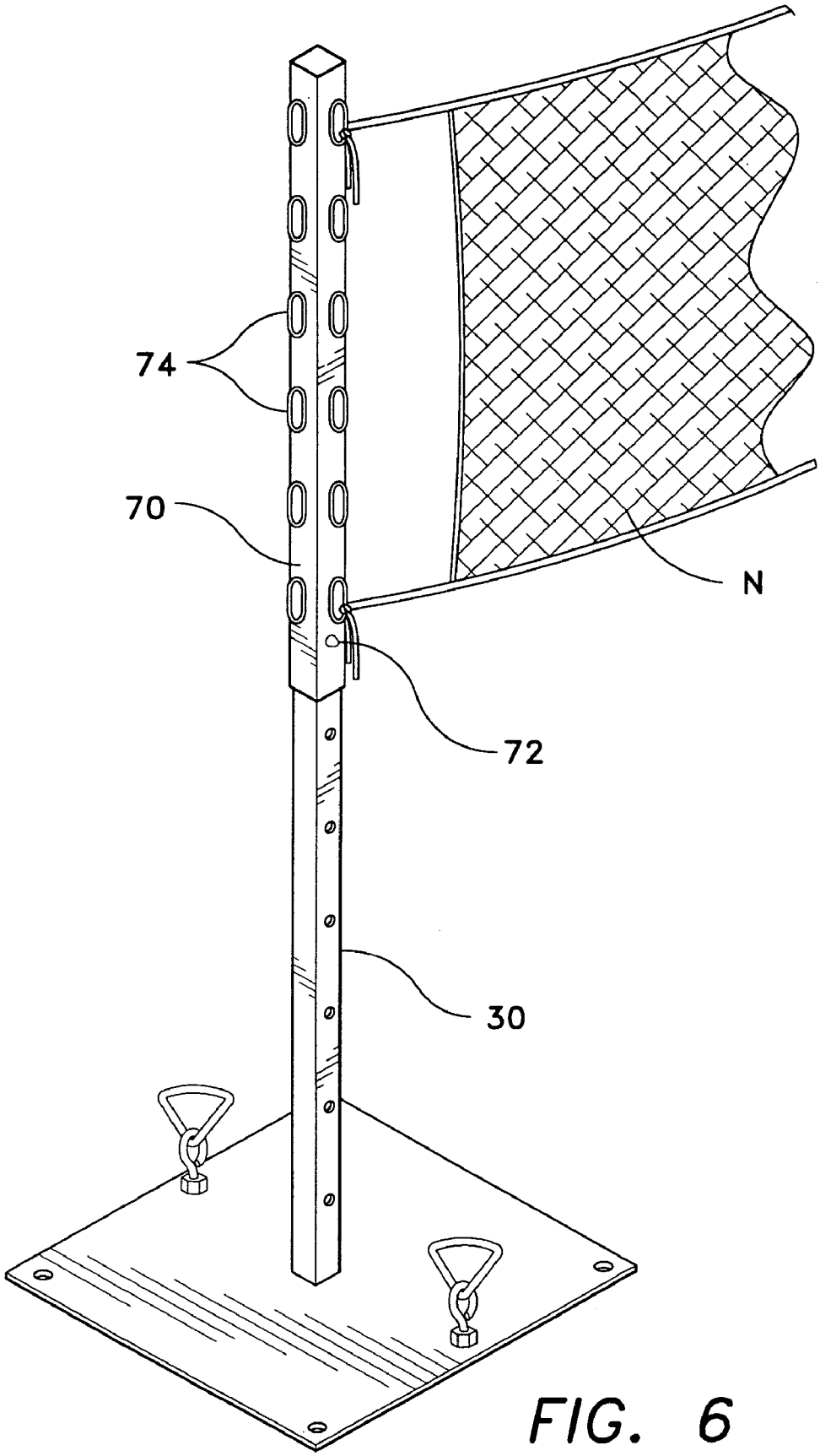
FIG. 6 is a perspective view of the interchangeable, modular ball game apparatus of the present invention with a vertical stem extension.

Turning now to FIG. 6, a vertical stem extension 70 may be slidably mounted onto the stem 30. The height of the vertical stem extension 70 is fixed by inserting a pin 72 or bolt through aligned apertures in the stem extension 70 and the stem 30. The stem extension 70 includes a plurality of attachment rings 74 fixed on at least one side of the stem extension 70 to which a volleyball, badminton, tennis or rebound net N may be attached. One side of the net N hooks onto the attachment rings 74 and the other side of the net N hooks onto attachment rings 74 provided on another modular ball game apparatus 10. The stem extension 70 may be raised or lowered according to the height necessary for use with the net N.

A canopy covering or a large mesh net may be held between several of the modular ball game apparatuses 10. The covering or net is attached to the attachment rings 74 on the stem extensions 70 on each of the apparatuses 10, therefore providing a tent-like enclosure. The enclosure keeps thrown balls within a confined space so that users do not have to go far to recover the balls.

Figure 7:
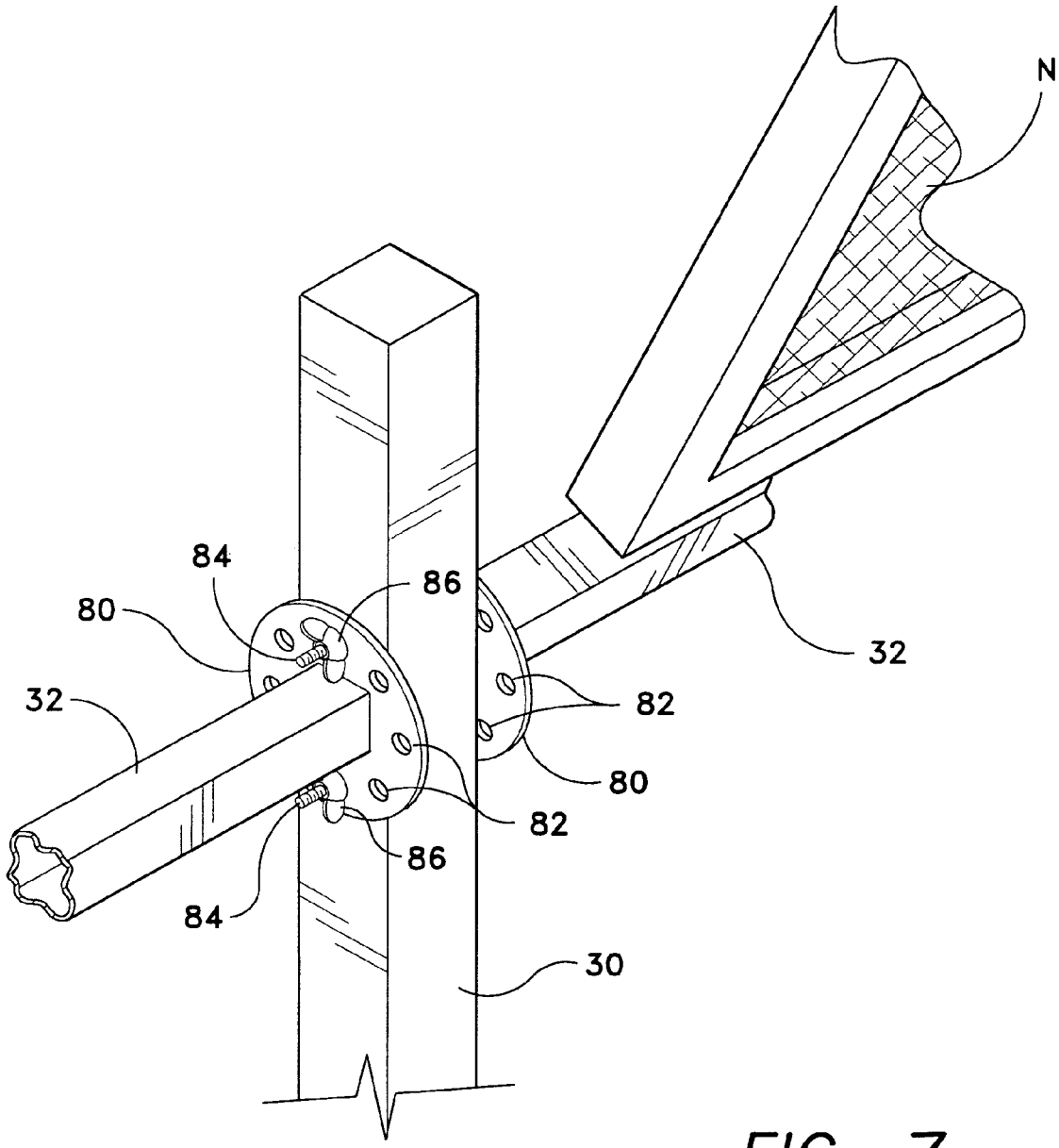
FIG. 7 is a perspective view of the interchangeable modular ball game apparatus of the present invention with attachment brackets attached to a stem.

FIG. 7 shows a perspective view of the modular ball game apparatus 10 with attachment brackets 80 affixed to the stem 30. The attachment brackets 80 have a plurality of apertures 82 disposed radially on the brackets 80. A middle screw is located in the center of each bracket 80, and one of the arms 32 is threaded onto the screw. The arm 32 may be welded directly to the attachment bracket 80. Two attachment screws 84 that are attached to the stem 30 allow the brackets 80 to be held to the stem 30.

Once the arm 32 is attached to the bracket 80, the bracket 80 is positioned against the stem 30 such that the attachment screws 84 are aligned with two specific apertures 82. Wing-nuts 86 or other fastening means hold the attachment bracket 80 onto the stem 30. Each set of apertures 82 sets the arm 32 at a designated angle, allowing the hoop 14 or other net to be positioned at that angle. When used with a bounce-back net, a user will be able to throw the ball and have it rebound to them depending on the angle at which the user has set the arm, and thereby, the net.

Figure 8:
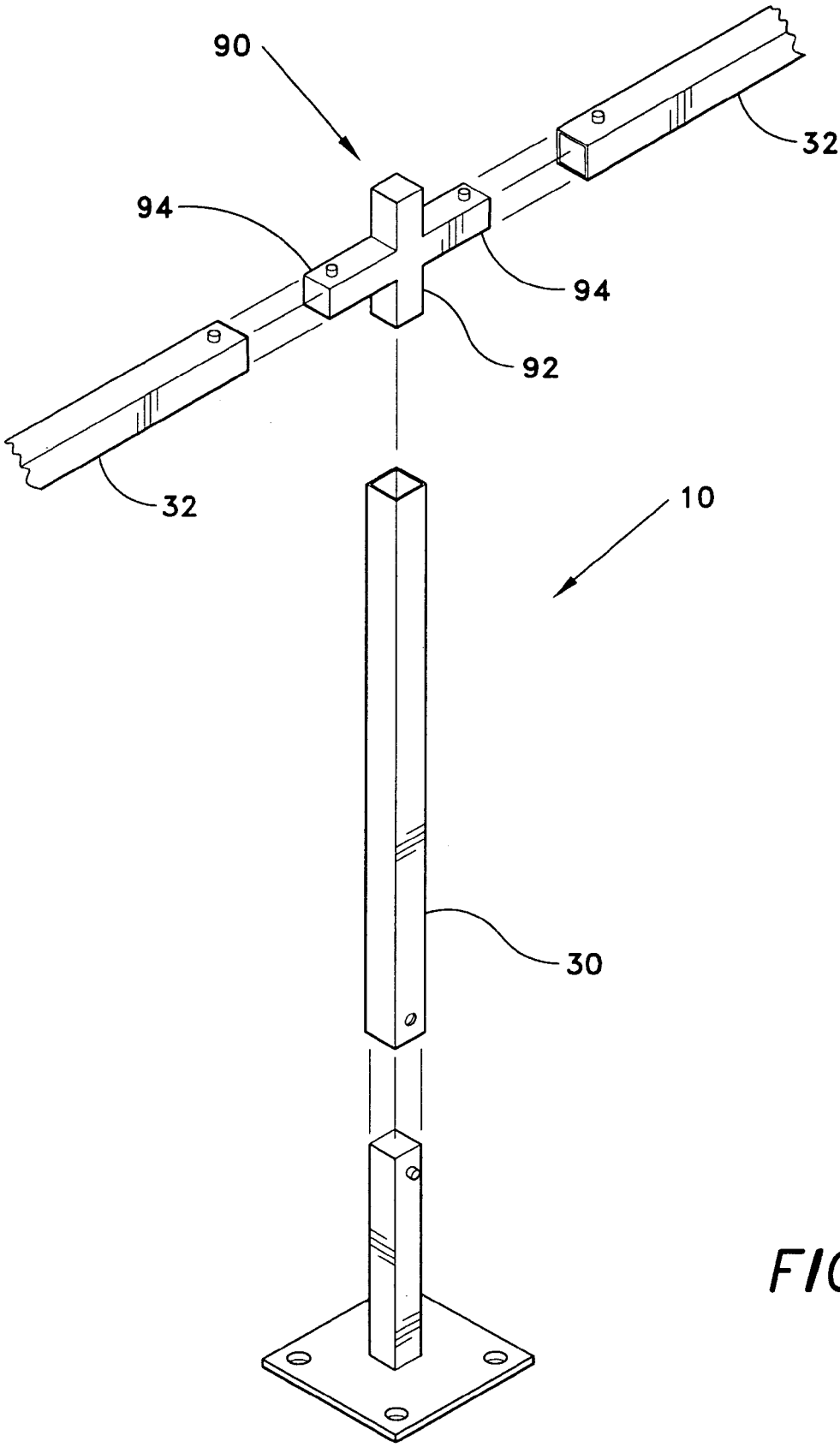
FIG. 8 is a perspective view of the interchangeable, modular ball game apparatus of the present invention with a connector.

FIG. 8 shows a perspective view of the modular ball game apparatus 10 with a T-shaped connector 90. The connector 90 fits into the top of the stem 30. The connector 90 has a stem-engaging middle bar 92 and a pair of arm-engaging side members 94 on either side of the middle bar 92. The stem-engaging bar 92 telescopes into the top end of the stem 30, and each side member 94 telescopes into an open end of an arm 32. The T-shaped connector 90 therefore allows for more arms 32 to be attached to the stem 30 so that more hoops and nets may be held. The connector 90 also allows for multiple apparatuses 10 to be joined together by connecting various stems 30 to the arms 32 connected to the T-shaped connector 90.

In use, the interchangeable, modular ball game apparatus 10 may be set up in any desired location. The base 20 may be freestanding, or it may be anchored in concrete or buried in the soil for permanent installation in parks, schools and other public facilities. The arms 32 may be permanently mounted to the stem 32, if desired; however, preferably the arms 32 are removably installed as needed in order to take advantage of the modular nature of the apparatus 10. The arms 32 may be furnished in a variety of lengths, e.g., an arm 32 supporting a soccer or lacrosse net 12 may require a longer supporting arm than a triangular hoop 14.

Any number of arms 32 may be added to the stem 30 at any desired height. Further, if the arm height, length, and radial orientation is acceptable, a hoop having one geometric shape may be removed from the arm 32 and replaced with a hoop having a different geometric shape. Hence, the components of the apparatus are modular and interchangeable.

Figure 9:
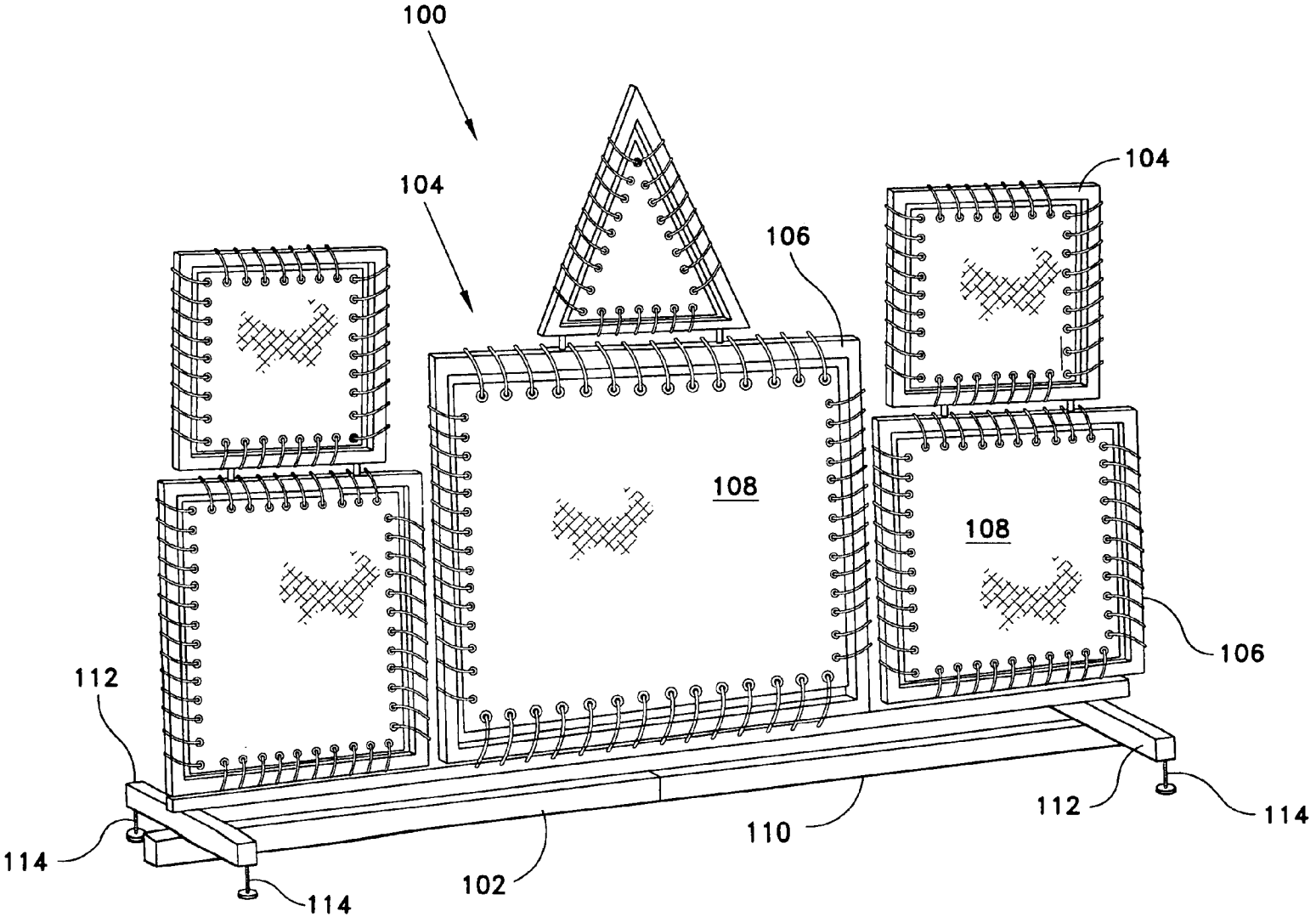
FIG. 9 is an elevational front view of the interchangeable, modular ball game apparatus according to a second embodiment of the present invention.

Referring now to FIG. 9, a second embodiment of the modular ball game apparatus 100 is shown. The second embodiment of the apparatus 100 has a horizontal beam stand 102 onto which a plurality of hoops 104 are attached. The hoops 104 each have a rim 106 and a net 108 attached to the rim 106. The rims 106 are affixed to the stand 102. The net 106, which may be a bounce-back net, is secured to each of the rims 106 so that a user may bounce a ball against the net 108 and the net 108 rebounds the ball back to the user. In addition to being a bounce-back net, the net 108 may have a mesh that retains a ball within the net 108 to be retrieved later. The rims 106 may be welded directly onto the stand 102 or may be attached to the stand 102 using mounting screws.

The stand 102 includes a middle beam 110, which is adjustable in length, that holds the rims 106 and a pair of side bars 112 that stabilize the stand 102. The side bars 112 each have a pair of feet 114 set under the side bars 112 which steady the side bars 112 on the surface the stand 102 is placed.

Although rectangular 42, triangular 14 and circular 40 hoops are shown in the drawings, it will be understood that the present invention is not limited to hoops having these shapes, but encompasses hoops of any other geometric shape, e.g., oval, hexagonal, etc. The interchangeable, modular ball game apparatus 10 and 100 and its components can be made out of metal or plastic. The apparatus can be used in an outdoor or indoor setting and is primarily used for recreational and athletic use, although it can be used for physical therapy or rehabilitation as well.

The multidimensional interchangeable modular ball game apparatus can be used for throwing, kicking and hitting any type of ball, e.g., a baseball, basketball, soccer ball, football, etc., that the user desires to play with and can improve a user's hand-eye and foot-eye coordination, as well as providing the user with aerobic and cardiovascular conditioning.

It is to be understood that the present invention is not limited to the embodiments described above, but encompasses any and all embodiments within the scope of the following claims.

I claim:

1. An interchangeable, modular ball game apparatus, comprising:

a base;

a vertical stem extending upward from the base, said stem including a plurality of vertically spaced holes;

a first arm having a first end and a second end, said first end of said first arm including means attaching said first arm to said stem, and said second end of said first arm having a transverse opening extending therethrough;

a first hoop attached to said first arm;

said first hoop having a rim, a net attached to the rim, and a pin attached to said rim, said pin extending outwardly from said rim;

wherein said first hoop is attached to the second end of said first arm by said pin, which is rotatably secured in the transverse opening of the second end of said first arm;

a second arm having a first end and a second end;

said first end of said second arm including means attaching the second arm to said stem;

a second hoop attached to said second arm;

said second hoop having a rim, a net attached to the rim, and at least one mounting sleeve attached to the rim;

wherein said second hoop is attached to said second arm by said at least one mounting sleeve, which is slidably engaged over said second arm.

2. The interchangeable, modular ball game apparatus of claim 1, wherein said means attaching said first arm to said stem comprises a tubular sleeve attached to said first end of said first arm, said tubular sleeve slidably engaging said stem, said tubular sleeve further including an adjustment pin for engaging one of said plurality of spaced holes in said stem;

wherein the height of said first arm and said first hoop is adjusted by sliding said tubular sleeve to a desired location along said stem and inserting said adjustment pin in one of said vertically spaced holes.

3. The interchangeable, modular ball game apparatus of claim 1, wherein said means attaching said second arm to said stem comprises a tubular sleeve attached to said first end of said second arm, said tubular sleeve slidably engaging said stem, said tubular sleeve further including an adjustment pin for engaging one of said plurality of spaced holes in said stem;

wherein the height of said second arm and said second hoop is adjusted by sliding said tubular sleeve to a desired location along said stem and inserting said adjustment pin in one of said vertically spaced holes.

4. The interchangeable, modular ball game apparatus of claim 1, wherein said means attaching said first arm to said stem includes an attachment bracket comprising a plate having a series of radially spaced apertures, said plate being mounted on the first end of said first arm; and a pair of screws attached to said stem for engaging said radially spaced apertures; wherein the angle of said first arm and said first hoop may be adjusted by the engagement of various pairs of said radially spaced apertures with said pair of screws.

5. The interchangeable, modular ball game apparatus of claim 2, wherein said means for attaching said second arm to said stem includes an attachment bracket comprising a plate having a series of radially spaced apertures, said plate being mounted on the first end of said second arm; and a pair of screws attached to said stem for engaging said radially spaced apertures;

wherein the angle of said second arm and said second hoop may be adjusted by the engagement of various pairs of said radially spaced apertures with said pair of screws.

6. The interchangeable, modular ball game apparatus of claim 1, wherein the base has a plurality of anchoring holes defined therein.

7. The interchangeable, modular ball game apparatus of claim 1, further comprising a vertical stem extension slidably mounted onto said stem.

8. The interchangeable, modular ball game apparatus of claim 7, further comprising a plurality of rings fastened to said vertical stem extension.

9. The interchangeable, modular ball game apparatus of claim 7, further comprising an additional hoop, said additional hoop having a tubular mount attached thereto, and extending downward therefrom, said tubular mount configured to telescopically engage the upper end of said vertical stem.

10. The interchangeable, modular ball game apparatus of claim 1, further comprising a connector having a middle bar and a pair of side members extending to either side of the middle bar, the middle bar being configured to telescope into said stem, and each of the side members being configured to telescope into an end of said first or second arm.

11. The interchangeable, modular ball game apparatus of claim 1, wherein said apparatus further includes at least third and fourth arms, each of said at least third and fourth arms having a first end and a second end, each of said at least third and fourth arms having attachment means located at said first end for attaching the arm to said vertical stem;

at least third and fourth hoops of different geometric shapes, each hoop of the at least third and fourth hoops having a rim and a net attached to said rim, each hoop of said at least third and fourth hoops being attached to one of said at least third and fourth arms;

wherein the attachment means of said at least third and fourth arms are interchangeably and adjustably attached to the vertical stem, thereby providing a modular apparatus that is interchangeable into different configurations.

12. A kit for the assembly of an interchangeable, modular ball game apparatus, said kit comprising:

(a) abase;

(b) a stem, said stem being attachable to said base in a vertical orientation;

(c) a set of arms, each of the arms of the set of arms including attachment means at one end for attachment to said stem, and a transverse opening extending through the other end of each arm;

(d) a first set of hoops of various geometric shapes, each of said first set hoops including a rim, a net attached to said rim and a pin attached to and extending outwardly from said rim, said pin for rotatably securing a hoop of the first set of hoops to a transverse opening of an arm; and (e) a second set of hoops of various geometric shapes, each of said second set of hoops including a rim, a net attached to the rim and at least one mounting sleeve attached to the rim, said at least one mounting sleeve for sliding over an arm.

13. The kit for the assembly of an interchangeable, modular ball game apparatus of claim 12, wherein said kit further comprises:

at least one vertical stem extension slidably mountable onto said vertical stem, said at least one vertical stem extension including a series of securing means thereon.

14. The kit for the assembly of an interchangeable, modular ball game apparatus of claim 13, wherein said kit further comprises:

at least one additional hoop having a rim and a net attached to said rim;

said additional hoop having a tubular mount attached thereto and extending downward therefrom, said tubular mount configured to telescopically engage the upper end of said stem.

15. The kit for the assembly of an interchangeable, modular ball game apparatus of claim 12, wherein said kit further comprises:

at least one connector having a middle bar and a pair of side members extending to either side of the middle bar, the middle bar being configured to telescope into said stem, and each of the side members being configured to telescope into an end of an arm.

* * * * *